United States Patent [19]

Smits et al.

[11] 4,254,583

[45] Mar. 10, 1981

[54] WINDOW UNIT

[75] Inventors: Denis L. Smits, St-Hilaire; Helmut Schmidt, Otterburn Park, both of Canada

[73] Assignee: Superseal Corporation, St. Hyacinthe, Canada

[21] Appl. No.: 615,370

[22] Filed: Sep. 22, 1975

[51] Int. Cl.[3] ..... E05D 15/28

[52] U.S. Cl. ..... 49/246

[58] Field of Search ..... 49/246, 248, 250, 251, 49/252, 260, 339, 341, 342, 343, 425, 427, 501, DIG. 1, DIG. 2; 52/616

[56] References Cited

U.S. PATENT DOCUMENTS

| | | | |
|---|---|---|---|
| 2,585,122 | 2/1952 | Hartman | 49/343 |
| 2,927,354 | 3/1960 | Lauer | 49/501 |
| 3,258,874 | 7/1966 | Martin | 49/252 |
| 3,555,735 | 1/1971 | Weikert | 49/501 |
| 3,815,285 | 6/1974 | Kuyper | 49/501 |
| 3,859,754 | 1/1975 | Budich et al. | 49/501 |
| 3,896,589 | 7/1975 | Mitchell | 49/501 |

*Primary Examiner*—Peter M. Caun

*Attorney, Agent, or Firm*—Cushman, Darby & Cushman

[57] ABSTRACT

The border element of a double glazed window unit of the casement of awning type includes an elongate unitary body formed entirely of vinyl plastics; its cross-section defines: a glass-receiving base portion including a web and a pair of legs surrounding the outer marginal edges of the glass sheets; a first enclosed hollow portion integral with the opposite face of the web and defining a first insulation chamber; and a second enclosed hollow portion integral with one of the pair of legs and with the front wall of the first chamber to thereby define a second insulation chamber. A window unit is thus provided where the metallic components used for the support and the operation of the window are enclosed within these insulation chambers and where effective insulation between both faces of the window unit may still be maintained.

7 Claims, 11 Drawing Figures

WINDOW UNIT

FIELD OF THE INVENTION

The present invention relates to a novel window unit and, more particularly, to manually operable windows, such as those known as casement windows or awning windows.

BACKGROUND OF THE INVENTION

Present casement or awning window assemblies include, between the glass panel and the rectangular frame in which it is mounted, a bulky structure consisting of wood parts and which is not easily dismountable should it be required to remove the glass panel from the frame. The wooden structure does not provide, in most cases, the desired insulation which it must maintain between both sides of the window assembly, especially in locations where important atmospheric differential exists, at certain time of the year, between the outside and the inside of a building.

OBJECTS OF THE INVENTION

It is an object of this invention to provide a simple window assembly for use as a casement window or as an awning window.

It is an object of this invention to provide an improved window unit which may be mounted directly to the window frame without the aid of intermediate wooden supports.

It is also an object of this invention to provide a novel window assembly of the type described which provides adequate insulation between both sides of the window unit.

The present invention combines the features of a light window unit, made of relatively light and inexpensive material, such as plastics, with that of suitable insulation between both sides of the window unit.

The present invention is achieved by providing a double glazed window unit which includes a series of border elements entirely formed of vinyl plastics. The cross-sectional profile of each border element is characterized by a glass-receiving base portion that consists of a web portion and of a pair of leg portions projecting from the web portion; these leg portions are adapted to surround the outer marginal edges of the glass sheets. The cross-section of each border element further includes two insulation chambers: a first chamber is defined by an enclosed portion integral with the opposite face of the web portion and the second chamber is defined by a second enclosed portion integral with one of the pair of leg portions and with the front wall of the first chamber. These two insulation chambers provide a temperature barrier between the outside and the inside of the window unit.

This novel construction of a border element allows the window unit to be mounted directly to a correspondingly-shaped window frame. By inserting in one of the insulation chambers of some of the border elements a reinforcing member, it is possible to construct a rigid casement-type window assembly and an awning-type window assembly which are still relatively light and which may be easily mounted in or dismounted from the window frame without intermediate wooden structure. In the casement window assembly, this reinforcing member serves to receive one extremity of the manually operable arm of the operator associated with the casement window. The same reinforcing member also serves to receive the hardware fixtures which serve to enable the window unit to pivot and to slide relative to the window frame. A similar reinforcing member is mounted in the head portion of the window unit to receive the head fixtures which act as hinge means for the pivotable and sliding movements of the window unit relative to the window frame. Depending on the size of the window unit, a reinforcing member may or may not be installed in the jamb portions of the unit. In the case of an awning window assembly, a reinforcing member is provided in each jamb portion of the window unit and serves to receive the hinge fixtures which permit the pivotable and sliding movements of the window unit relative to the window frame.

Therefore, the reinforcing member has a triple function: reinforcing the window unit, serving as a hinge attachment means and (in the case of the casement type window) a guide rail for the manual operator.

In one form of the invention, the periphery of the window frame is provided, on the outside thereof, with a covering of vinyl plastics. By suitably positioning weather strips on the border elements and on this covering, further insulation chambers are defined between both sides of the glass panel.

STATEMENT OF THE INVENTION

The present invention therefore relates to the novel construction of a border element for use in a double glazed window unit that includes a pair of spaced glass sheets; the border element comprises an elongate unitary body formed entirely of vinyl plastics; the body has a cross-section that first includes a glass-receiving base portion consisting of a web portion and of a pair of leg portions projecting from one face of the web portion at opposite edges thereof; the cross-section of the body further includes a first enclosed portion integral with the opposite face of the web portion and defining a first elongate hollow insulation chamber with front and rear walls; the cross-section of the body further includes a second enclosed portion integral with one of the pair of leg portions and with the front wall of the first chamber to define a second elongate hollow insulation chamber.

The present invention also relates to a novel sealed double glazed window unit which includes the above-described border element and which is specifically constructed to be used as a casement-type window unit or as a awning-type window unit.

In the case of a casement window assembly, a reinforcing member is mounted in both the sill portion and the head portion of the window unit. In the sill portion, the inside wall of the border element is provided with an elongate opening to receive the arm of a manual operator for opening and closing the window unit.

In the case of an awning window assembly, the reinforcing members are further mounted in the jamb portions of the window unit so that the hardware fixtures, which allow the window unit to pivot and to slide relative to the window frame, may be fixedly attached.

Other objects, purposes and characteristic features of the present invention will be, in part, obvious from the accompanying drawings and, in part, pointed out as the description of the invention progresses. In describing the invention in detail, reference will be made to the accompanying drawings, in which like reference characters designate corresponding parts throughout the several views.

DESCRIPTION OF PREFERRED EMBODIMENTS

Figure 8:
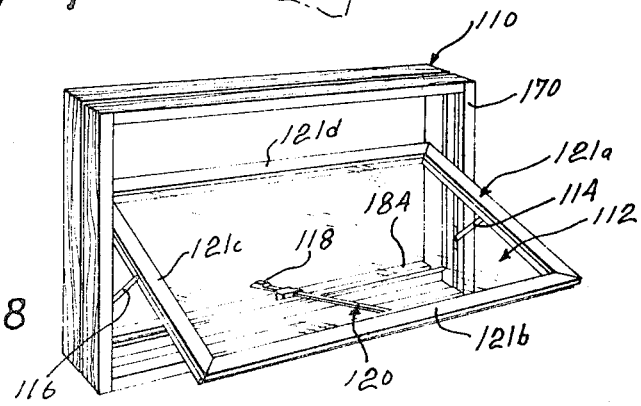
FIG. 8 is a perspective view of an awning window assembly made in accordance with the present invention.
Figure 10:
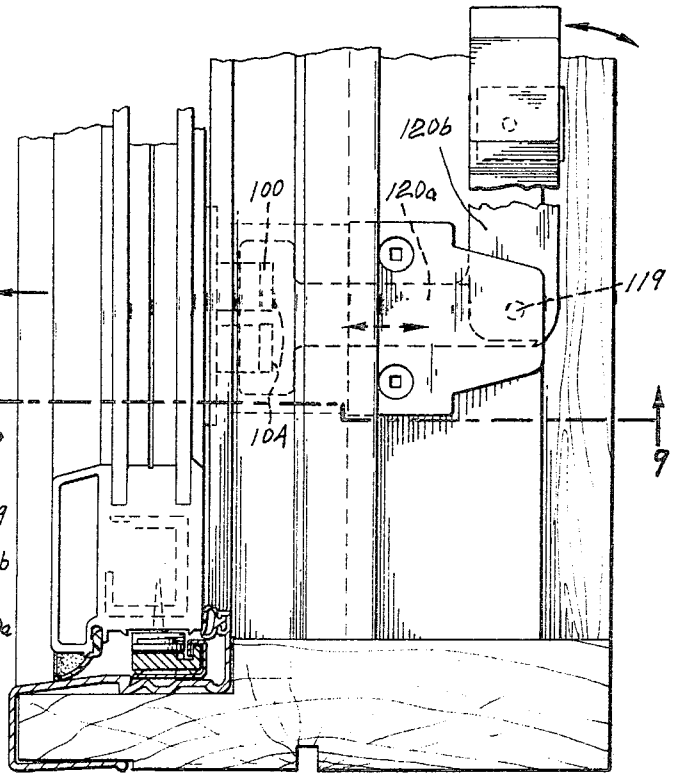
FIG. 10 is a plane cross-sectional view of the awning window assembly of FIG. 8, with the glass panel shown in the closed position.
Figure 9:
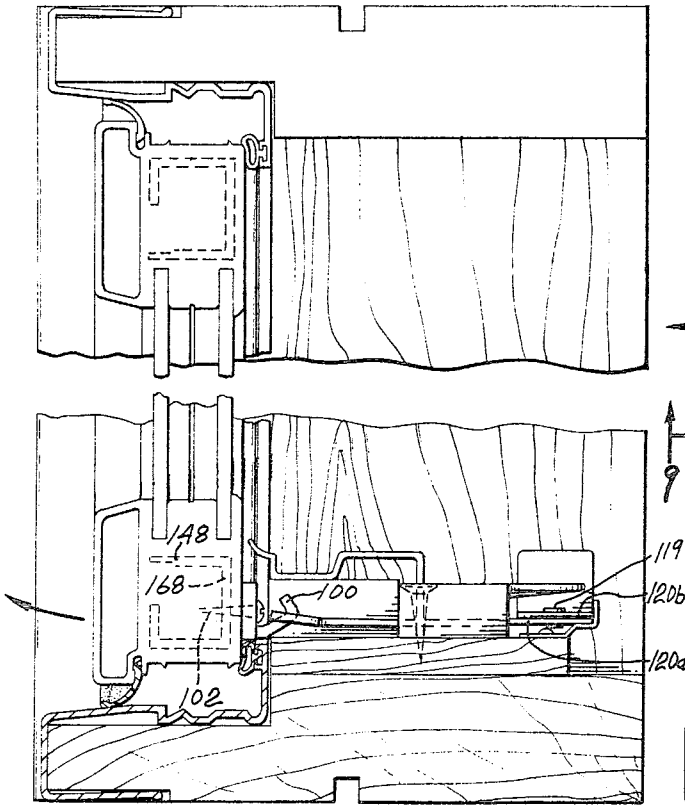
FIG. 9 is an elevation cross-sectional view of the awning window assembly of FIG. 8, with the glass panel shown in the closed position.

In the drawings, there will be described two preferred embodiments of the present invention: a casement window assembly (FIGS. 1–7) and an awning window assembly (FIGS. 8–10).

Figure 1:
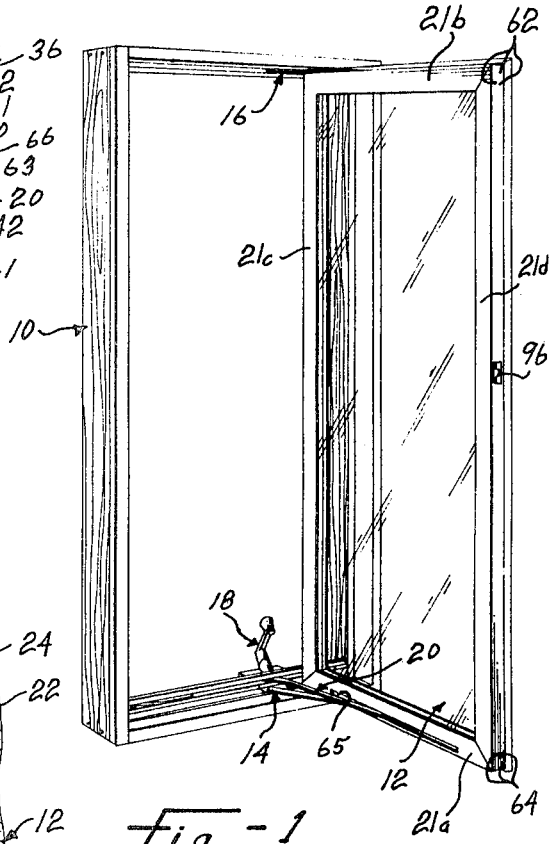
FIG. 1 is a perspective view of a casement window assembly made in accordance with the present invention.
Figure 2:
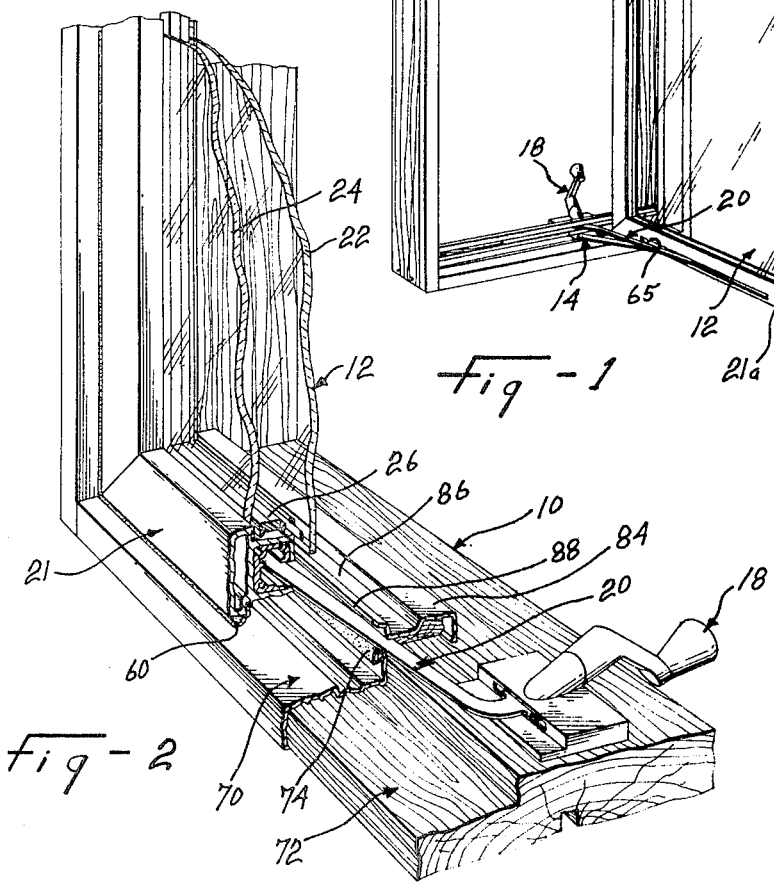
FIG. 2 is a fragmented perspective view of the window assembly shown in FIG. 1.
Figure 4:
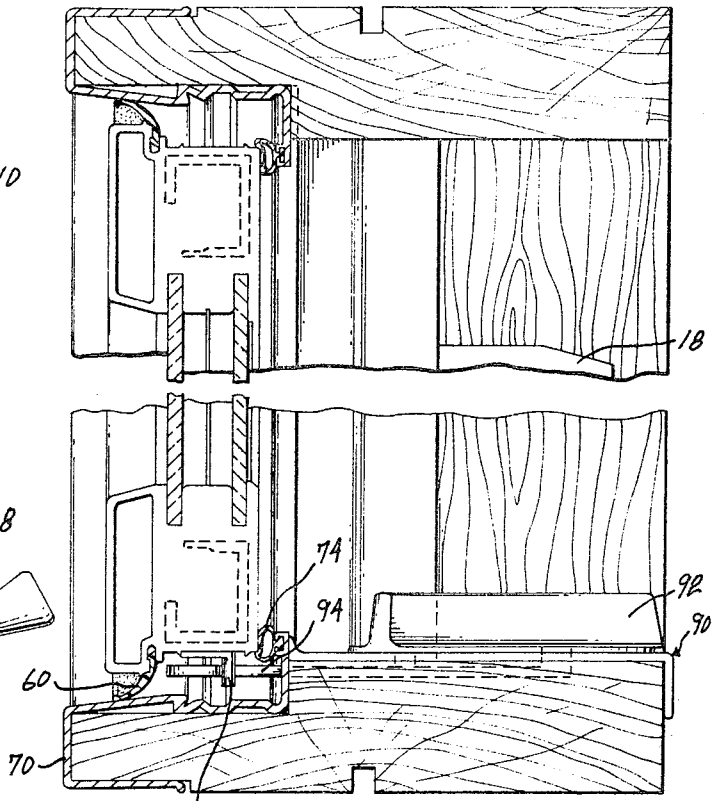
FIG. 4 is a plane cross-sectional view of the casement window assembly of FIG. 1 with the glass panel shown in the closed position.
Figure 3:
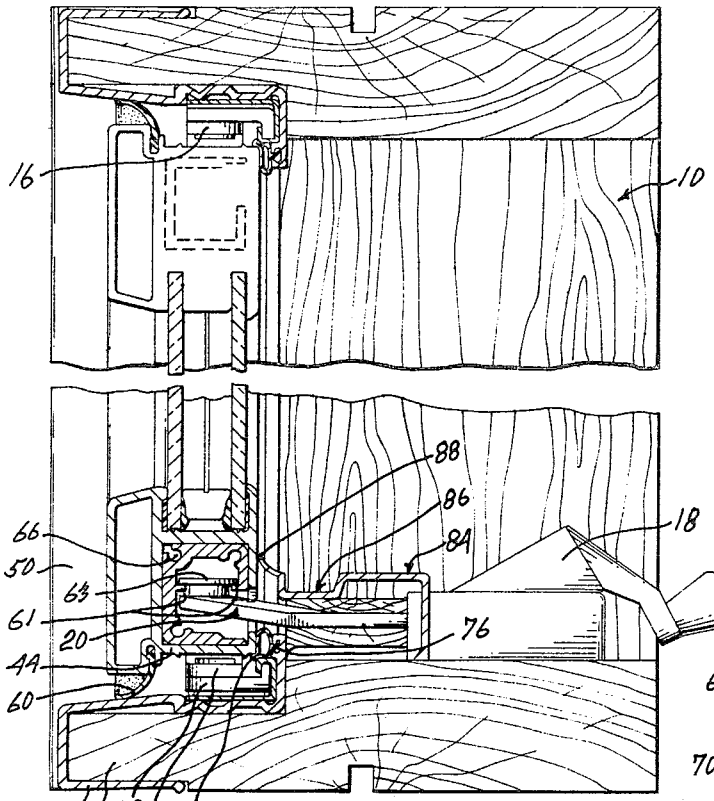
FIG. 3 is an elevation cross-sectional view of the casement window assembly shown in FIG. 1 with the glass panel shown in the closed position.
Figure 5:
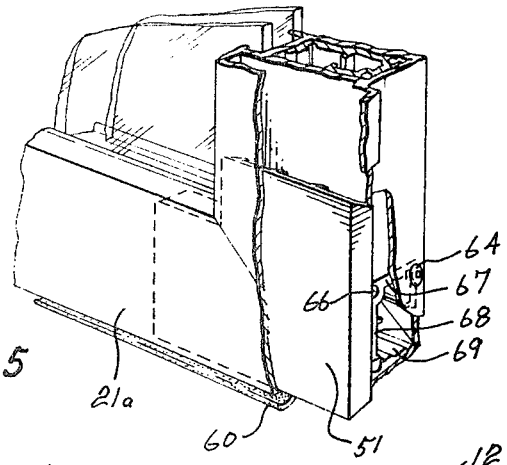
FIG. 5 is a fragmented enlarged perspective view of a corner of the glass panel of the present invention.

The window assembly of FIG. 1 consists of a window frame 10 and of a sealed double glazed window unit 12. The unit 12 is mounted to the frame 10 by means of two hinge mechanisms, generally denoted as 14 and 16, at the lower and upper parts of the window unit. These hinge mechanisms consist of hardware fixtures which are well known in the window art and which allow the window unit to pivot and to slide relative to the window frame. The combination of these two movements of the window unit provide, as seen in the open position shown in FIG. 1, an opening between the innermost jamb portion of the window unit and the window frame thereby allowing access to the outside panel of the window unit for cleaning purposes, for example. A manual operator 18 is fixedly mounted to the sill of the window frame and includes an arm 20 operatively connected to the window unit 12 to permit this pivotable and sliding movements of the window unit relative to the window frame.

The casement window assembly generally described above as well as the awning window assembly described hereinbelow are the results of a combination of separate novel elements which will now be described in greater detail.

BORDER ELEMENT

One of these features is a novel border element, generally denoted by reference 21, which peripherally surrounds a pair of glass sheets 22 and 24 arranged in spaced parallel relationship and defining an air space therebetween. A spacing unit 26 is disposed between the inner marginal edges of the glass sheets and extends completely around the periphery thereof to maintain the sheets in spaced relationship. The construction of the spacing unit 26 is considered to be well known in the window art; it may be said generally that it usually contains a desiccant which, by means of a series of openings disposed on the air space side of the spacing unit, is in communication with the air space between the glass sheets. One example of such spacing unit is described in applicant's Canadian Pat. No. 953,159 issued Aug. 20, 1974. The edges of the glass sheets 22 and 24 and the spacing unit 26 are received within the glass receiving base portion of the border element 21.

The protection border element 21 is entirely formed of vinyl plastics material. One vinyl plastics which has been found to be highly suitable is one known under the trademark GEON Plastic 8700-A. The cross-section of each border element is composed of a web portion 30 and of a pair of leg portions 32 and 34 defining with the web portion a channel completely surrounding the outer marginal edges of the glass sheets and extending around the periphery thereof. As can be seen, the leg portions 32 and 34 are, respectively, provided with inwardly projecting lips 36 and 38 forming under pockets which are adapted to receive an adhesive sealant. It will be evident to the man skilled in this art to provide an adequate sealant for bonding glass to vinyl plastics; however, one example of such sealent is a polysulfide-base product. Integral with the opposite face of web portion 30 are front and rear walls 40 and 42 which, together with opposite wall 44, define an enclosed elongate hollow chamber 46. This chamber serves as an insulation between both sides of the window unit.

As described hereinafter, depending on the type and size of the window unit for which this border element is used, this chamber 46 may be empty or it may receive a reinforcing element 48 as described hereinbelow.

Integral with leg portions 34 and with front wall 40 of chamber 46, there is provided a second elongate hollow chamber 50 which is defined by upper and lower walls 52 and 54 and outside wall 56 and which serves as a second insulating separation between both sides of the window unit. This insulation chamber 50 is empty except for correspondingly shaped corner gussets 51 (see FIG. 5). By having these corner gussets made of the same shape, material and color as that of the border element, any play resulting from temperature contraction or expansion of the border element will be taken by these corner elements.

Border element 21 further includes a groove 58 longitudinally extending outside the two chambers 46 and 50 and extending substantially in the prolongation of wall 40 which is common to both chambers, to receive a weatherstrip 60, the function of which will hereinafter be described.

WINDOW UNIT

The novel border element described above enables the construction of a novel window unit. Such window unit will consist of a series of border elements 21, such as the window unit 12 in FIG. 1 which includes a sill portion 21*a*, a head portion 21*b* and two jamb portions 21*c* and 21*d*. These window units may vary in construction depending on their use and, for example, these various border portions may or may not incorporate reinforcing members 48. When the window unit is used in a casement window assembly, such as shown in FIG. 1, at least border portions 21*a* and 21*b* must be provided with a reinforcing element for fixedly receiving the hinge fixtures 14 and 16. Depending on the height of the window unit, reinforcing members 48 may or may not be provided in border elements 21*c* and 21*d*.

CASEMENT WINDOW ASSEMBLY

Figure 2A:
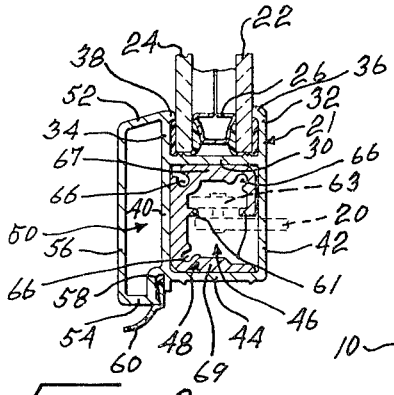
FIG. 2*a* is a cross-sectional view showing the novel border element used in connection with the present invention.

The reinforcing member 48 may have various shapes; however, one preferred shape is shown in FIG. 2*a* for use in a window unit particularly intended to be used in a casement window assembly. The cross-section of this reinforcing member includes at least three full side walls 67, 68 and 69 which are in surface contact with the corresponding inner walls of web portion 30, side portions 40 and 44 of the enclosed chamber 46. Screw loops 66 are provided in each corner of the cross-section of this reinforcing member to receive at each end of the border element a series of screws 64 securing adjacent border elements together.

A similar reinforcing member is mounted in the upper head portion 21*b* of the window unit. Again, screws 62 are provided at each end of this head portion to secure it to adjacent jamb portions 21*c* and 21*b*.

In the sill portion of the window unit, the open side of the reinforcing member faces the inside of the room in which such window unit may be mounted. On the inside wall of border element 21*a*, an elongate slot 65 receives the actuatable arm 20 of the manual operator 18. A roller mechanism 63 is mounted on the extremity of arm 20 and has an under portion bearing longitudinally on two guiding and supporting flanges 61 and 63 extending inside reinforcing member 48. The reinforcing member may be made of extruded aluminum; hence, various configurations, such as screw loops 66 and flanges 61, may easily be formed on the reinforcing member.

Figure 6:
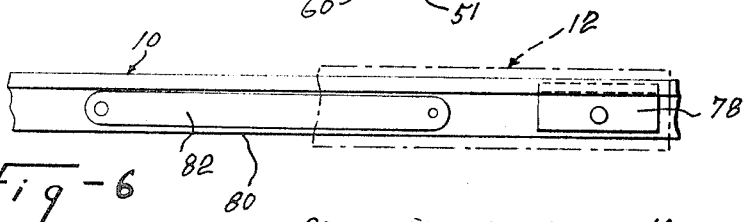
FIGS. 6 and 7 are diagrammatic representations of two positions of the hardware fixtures used with the present window assembly.
Figure 7:
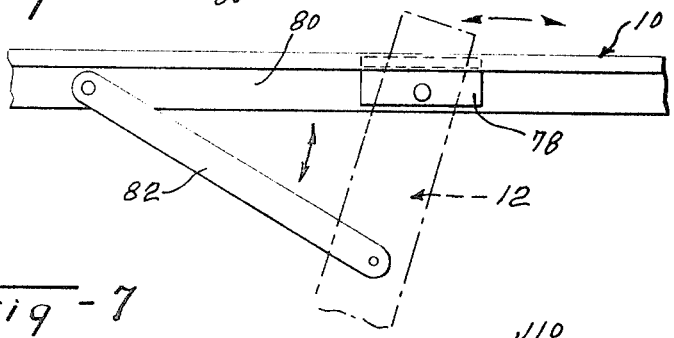

The casement window assembly further consists of a flexible covering 70 which may be easily fitted over the outer periphery of the window frame 10. This covering is preferably made of plastics material. A weatherstrip 74 is snuggly received in an appropriate groove 76 at one end of covering 70. As can be seen from FIG. 3, an additional insulation chamber is formed when the window unit is closed in the window frame; this chamber is defined by weatherstrip 60, wall 44, weatherstrip 74 and that portion of covering 70 which lies underneath wall 44. In the case of a casement window assembly, the hardware fixtures allowing the pivotal and sliding movement of the window unit are received in this chamber. As indicated above, the construction of these fixtures is well known in the art; however, referring to FIGS. 6 and 7, an illustration of the hinging operation of these fixtures is given to show how the window unit may pivot and slide relative to the window frame. One edge of window unit 12 is pivotally connected to a slider 78 which is guided along a metallic bar 80 provided over covering 70, but fixed to frame 10. A linking arm 82 pivotally connects bar 80 to the window unit. In FIG. 6, window unit 12 is shown in the closed position while, in FIG. 7, it is shown once it has pivoted and slid in the open position.

A similar hinge mechanism is provided between the frame 10 and the head portion 21*b* of the window unit.

A second extrusion 84 may be provided (see FIG. 2) on the window sill to receive a screen (not shown). This extrusion 84 is made of plastic material and includes a recess portion 86 to receive the screen and a drip collecting edge 88 bearing against the inside wall 42 of the border element 21 to direct droplets formed on this side of the window into recess 86.

To lock the window unit in the closed position, a manual lock 90 consists of a rotatable finger gripping portion 92 operatively connected to a lever 94; one end of this lever is adapted to grasp a hook 96 fixedly secured to the jamb portion 21*d* of the window unit 12. In cases where reinforcing members are used in the jamb sections of the window unit, this hook 96 may be fixed directed to the reinforcing member. One particular advantage of the present invention is that with the elimination of intermediate supports between window unit and window frame, it is possible to cut-out of the jamb on the window frame portion and to install the lock directly in the frame as shown in the drawings.

AWNING WINDOW ASSEMBLY

Referring to FIGS. 8–10, there is shown an awning window assembly which consists of a frame 110 and of a window unit 112. Again, this is a type of window which pivots and slides so as to allow free access to both faces of the glass panels.

The window unit includes border elements 121*a*, 121*b*, 121*c* and 121*d*, the cross-section of which is almost identical to the border element 21 described above in connection with the casement window assembly. There are two structural differences: first, referring to FIGS. 9 and 10, the sill portion 121*b* of the window unit used in this type of window assembly is not provided with an elongated slot to receive the manual operator 118; secondly, the reinforcing member 148 inside the border element 121*d* is rotated 180° so that its portion 168 faces the inside of the window assembly and that a hook member 100 may be fixedly attached, such as by screws 102 thereto. In the awning window assembly, a reinforcing member is preferably provided in each border element of the window unit, at least in jamb portions 121*a* and 121*c* where the hinge fixtures 114 and 116 are mounted.

The manual operator 118 shown includes an elongated arm 120 which is folded parallel to the sill of the window frame to lock the window unit in the closed position. This may be accomplished by providing a pivot 119 interconnecting portions 120*a* and 120*b* of the arm. Portion 128 is shown provided with two slots 104 at one end thereof to receive the correspondingly shaped hooks 100 attached to the window unit.

Structurally, the window frame 110 is identical to the window frame 10 shown in the figures relating to the casement window assembly. In other words, window frame 110 is provided with a similar edge covering 170 and may be provided with similar extrusions 184 to receive a screen.

It will be evident that, since no roller mechanism is required in an awning window assembly, the reinforcing member may be structured somewhat differently; for example, flanges 61 on the inside walls of the reinforcing member are no longer required.

What is claimed is:

1. A casement window assembly comprising: a window frame; a sealed double glazed window unit comprising:

(a) a pair of glass sheets arranged in spaced parallel relationship to form an air space therebetween;

(b) a spacing unit disposed between the inner marginal edges of the glass sheets and extending completely around the periphery thereof to maintain the sheets in space relationship;

(c) a border formed of interconnected elements made entirely of vinyl plastics and extending completely around the periphery of said glass sheets, each said border element having a cross-section including a web portion and a pair of leg portions projecting from one face of said web portion and surrounding the outer marginal edges of the glass sheets; each said border element including a first enclosed hollow portion extending from the opposite face of said web portion and defining a first insulation chamber; said chamber including opposite front and rear walls; the rear wall of one of said border elements having a longitudinally extending opening therethrough;

(d) a reinforcing member received at least in each chamber of two opposite border elements; said two border elements including the border element having said opening therethrough;

(e) a manual operator means mounted on said window frame and having one arm extending through said opening; said arm having one extremity slidably mounted to the reinforcing member received in the associated border element; and (f) hinge means mounted to said window unit and to said window frame for pivotably mounting said window unit to said frame.

2. A casement window assembly as defined in claim 1, wherein each said border element includes a second elongate hollow portion defining a second insulation chamber; said second hollow portion being integral with one of said leg portions and with said front wall.

3. A casement window assembly as defined in claim 2, wherein each said border element includes a groove longitudinally extending outside said first and second chambers and disposed substantially in the prolongation of said front wall common to said first and second chambers; further comprising a weatherstrip having one end secured in said groove and the opposite end in contact engagement with said window frame to form, when said window is closed, a third insulation chamber; said hinge means being provided in one or more said third insulation chambers.

4. A casement window assembly as defined in claim 3, wherein said window frame includes on its outside portion thereof a covering of plastic material extending peripherally of said window frame.

5. A casement window assembly as defined in claim 4, further comprising a second weatherstrip received in a groove provided in said covering; said second weatherstrip disposed rearwardly of said first weatherstrip and contacting said rear wall of said border elements.

6. A casement window assembly as defined in claim 5, further comprising a further element of plastic material extending on the sill of said window frame; said element including a tip in contact engagement with said rear wall of the border element adjacent the sill of said window frame.

7. An awning window assembly comprising:

a window frame; a sealed double glazed window unit comprising:

(a) a pair of glass sheets arranged in spaced parallel relationship to form an air space therebetween;

(b) a spacing unit disposed between the inner marginal edges of the glass sheets and extending completely around the periphery thereof to maintain the sheets in space relationship;

(c) a border formed of interconnected elements made entirely of vinyl plastics and extending completely around the periphery of said glass sheets, each said border element having a cross-section including a web portion and a pair of leg portions projecting from one face of said web portion and surrounding the outer marginal edges of said glass sheets; each said border element including a first enclosed hollow portion extending from the opposite face of said web portion and defining a first insulation chamber; said chamber including opposite front and rear walls, said rear wall of said first enclosed hollow portion being continuous with the leg portion projecting from the other face of said web portion so that the interior boundary of said first enclosed hollow portion is substantially in alignment with the plane established by the interior surface of the inside pane;

(d) a reinforcing member received at least in each chamber of two opposite border elements;

(e) a manual operator means mounted on said window frame and having one arm operatively connected to one of said border elements;

(f) hinge means mounted to said window unit and to said window frame for pivotally connecting said window unit to said frame; and (g) a second elongated hollow portion defining a second insulation chamber, said second hollow portion being integral with the other one of said leg portions and with said front wall, wherein each said border element includes a groove longitudinally extending outside said first and second chambers and disposed substantially in the prolongation of said front wall common to said first and second chambers; further comprising a weatherstrip having one end secured in said groove and the opposite end in contact engagement with said window frame to form, when said window is closed, a third insulation chamber; said hinge means being provided in one or more said third insulation chambers, wherein said window frame includes on its outside portion thereof a covering of plastic material extending peripherally of said window frame further comprising a second weatherstrip received in a groove provided in said covering; said second weatherstrip disposed rearwardly of said first weatherstrip and contacting said rear wall of said border elements comprising a further element of plastic material extending on the sill of said window frame; said element including a tip in contact engagement with said rear wall of the border element adjacent the sill of said window frame.

* * * * *